US007178961B2

(12) United States Patent
Janning

(10) Patent No.: US 7,178,961 B2
(45) **Date of Patent: *Feb. 20, 2007**

(54) VOLTAGE REGULATED LIGHT STRING

(75) Inventor: John Louis Janning, Dayton, OH (US)

(73) Assignee: JLJ, Inc., Dayton, OH (US)

( * ) Notice: Subject to any disclaimer, the term of this patent is extended or adjusted under 35 U.S.C. 154(b) by 263 days.

This patent is subject to a terminal disclaimer.

(21) Appl. No.: 10/620,771

(22) Filed: Jul. 17, 2003

(65) Prior Publication Data

US 2005/0179400 A1 Aug. 18, 2005

Related U.S. Application Data

(60) Continuation-in-part of application No. 10/364,526, filed on Feb. 12, 2003, now Pat. No. 6,765,313, which is a continuation of application No. 10/061,223, filed on Feb. 4, 2002, now Pat. No. 6,580,182, which is a continuation of application No. 09/526,519, filed on Mar. 16, 2000, now abandoned, which is a division of application No. 08/896,278, filed on Jul. 7, 1997, now abandoned, which is a continuation of application No. 08/653,979, filed on May 28, 1996, now abandoned, which is a continuation-in-part of application No. 08/560,472, filed on Nov. 17, 1995, now abandoned, which is a continuation-in-part of application No. 08/494,725, filed on Jun. 26, 1995, now abandoned, application No. 10/620,771, and a continuation of application No. 10/141,156, filed on May 8, 2002, now Pat. No. 6,597,125.

(60) Provisional application No. 60/291,754, filed on May 17, 2001.

(51) Int. Cl.
*F21W 121/04* (2006.01)

(52) U.S. Cl. ..... 362/565; 362/568; 362/221; 315/185 S; 315/185 R

(58) Field of Classification Search ..... 362/565, 362/568, 219, 221, 227, 806, 217; 315/185 S, 315/185 R, 312; 324/403, 414
See application file for complete search history.

(56) References Cited

U.S. PATENT DOCUMENTS

| | | | |
|---|---|---|---|
| 1,024,495 | A | 4/1912 | Booth |
| 1,510,847 | A | 10/1924 | Holler |

(Continued)

FOREIGN PATENT DOCUMENTS

| | | |
|---|---|---|
| CA | 484968 | 7/1952 |
| CA | 1322022 | 9/1993 |
| CH | 427021 | 6/1967 |

(Continued)

*Primary Examiner*—Laura K. Tso
(74) *Attorney, Agent, or Firm*—Dickstein Shapiro LLP

(57) ABSTRACT

A string set of series-connected incandescent flasher type lamps in which substantially all of the lamp filaments in the set are individually provided with a voltage regulated shunt circuit, which includes a voltage responsive silicon semiconductor device, which operates in one of two conducting states, neither of which is greater than about 200 ohms. When the flasher lamp is in the "on" or illuminated state, the silicon semiconductor voltage regulating shunt device is in a low impedance state. When the flasher is in the "off" state, the impedance of the silicon semiconductor device is in a lower impedance state equal to or slightly greater than the parallel equivalent impedance of silicon semiconductor device in parallel with the normal operating impedance of the flasher lamp.

4 Claims, 4 Drawing Sheets

U.S. PATENT DOCUMENTS

| | | | | | |
|---|---|---|---|---|---|
| 2,072,337 | A | | 3/1937 | Kamm | |
| 2,760,120 | A | | 8/1956 | Fisherman | |
| 2,924,728 | A | | 2/1960 | Carlson | |
| 3,639,805 | A | * | 2/1972 | Muench et al. | 315/122 |
| 3,789,211 | A | * | 1/1974 | Kramer | 362/231 |
| 3,912,966 | A | | 10/1975 | Harnden, Jr. | |
| 4,211,955 | A | * | 7/1980 | Ray | 315/53 |
| 4,425,605 | A | | 1/1984 | Cheng | |
| 4,450,382 | A | * | 5/1984 | Sawka et al. | 315/82 |
| 4,631,650 | A | | 12/1986 | Ahroni | |
| 4,675,575 | A | | 6/1987 | Smith et al. | |
| 4,682,079 | A | | 7/1987 | Sanders et al. | |
| 4,727,449 | A | | 2/1988 | Fleck | |
| 5,006,724 | A | | 4/1991 | Liu | |
| 5,191,261 | A | | 3/1993 | Mass | |
| 5,239,236 | A | | 8/1993 | Backstrom et al. | |
| 5,243,510 | A | | 9/1993 | Chenny, II | |
| RE34,717 | E | | 9/1994 | Sanders et al. | |
| 5,345,147 | A | * | 9/1994 | Wu | 315/185 S |
| 5,453,664 | A | * | 9/1995 | Harris | 315/185 S |
| 5,777,868 | A | | 7/1998 | Gibboney, Jr. | |
| 5,886,423 | A | | 3/1999 | Gershen et al. | |
| 5,994,845 | A | | 11/1999 | Gibboney, Jr. | |
| 6,084,357 | A | | 7/2000 | Janning | |
| 6,323,597 | B1 | | 11/2001 | Janning | |
| 6,344,716 | B1 | * | 2/2002 | Gibboney, Jr. | 315/185 S |
| 6,396,219 | B1 | | 5/2002 | Tang | |
| 2002/0047594 | A1 | | 4/2002 | Janning | |
| 2003/0198048 | A1 | * | 10/2003 | Frederick | 362/249 |

FOREIGN PATENT DOCUMENTS

| | | |
|---|---|---|
| DE | 3828702 | 3/1990 |
| EP | 0481773 | 4/1992 |
| FR | 884370 | 8/1943 |
| FR | 2663183 | 12/1991 |
| GB | 12398 | 6/1908 |
| GB | 1095673 | 12/1967 |
| JP | S60-88499 | 6/1985 |
| WO | WO 97/46055 | 12/1997 |
| WO | WO 99/53729 | 10/1999 |
| WO | WO 99/58899 | 11/1999 |

* cited by examiner

300

| | SUSTAINING LEVEL | LAMP FILAMENT REPLACEMENT LEVEL |
|---|---|---|
| LAMP CURRENT | ~150 mA | 0 mA |
| LAMP IMPEDANCE | ~23 ohms | ∞ ohms |
| SHUNT CURRENT | ~65 mA | ~215 mA |
| SHUNT IMPEDANCE | ~54 ohms | ~16 ohms |

VOLTAGE REGULATED LIGHT STRING

This is a continuation-in-part of application Ser. No. 10/364,526, filed Feb. 12, 2003, now U.S. Pat. No. 6,765,313, which is a continuation of application Ser. No. 10/061,223, filed Feb. 4, 2002, now U.S. Pat. 6,580,182, which is a continuation of application Ser. No. 09/526,519, filed Mar. 16, 2000, now abandoned, which is a division of application Ser. No. 08/896,278, filed Jul. 7, 1997, now abandoned, which is a continuation of application Ser. No. 08/653,979, filed May 28, 1996, now abandoned, which is a continuation-in-part of application Ser. No. 08/560,472, filed Nov. 17, 1995, now abandoned, which is a continuation-in-part of application Ser. No. 08/494,725, filed Jun. 26, 1995, now abandoned.

This application is a continuation of application Ser. No. 10/141,156, filed May 8, 2002, now U.S. Pat. No. 6,597,125, which claims the benefit of U.S. Provisional Application Ser. No. 60/291,754, filed May 17, 2001, which is incorporated by reference herein in its entirety.

FIELD OF THE INVENTION

The present invention relates generally to improvements in series connected light strings. More specifically, the present invention relates to techniques for providing a string set of series-connected lamps in which each of the lamps may operate with a shunt circuit.

BACKGROUND OF THE INVENTION

One of the most common uses of light strings is for decoration and display purposes, particularly during Christmas and other holidays, and more particularly for the decoration of Christmas trees, and the like. Probably the most popular light sets currently available on the market, and in widespread use, comprise thirty-five or fifty miniature light lamps each, with each lamp typically having an operating voltage rating of 3.5 or 2.5 volts respectively, and whose filaments are connected in an electrical series circuit arrangement.

A string of lights may be made to flash, or turn on and off, by including a flasher light lamp as one of the light lamps of the string. Such a flasher light lamp typically includes a bi-metallic strip which conducts current to the filament. As the bimetallic strip heats up, it moves away from the filament and breaks the current connection, causing the bulb to turn off. The bi-metallic strip then cools and returns to the initial position, allowing current to flow and begin the on and off cycle again. All of the bulbs in such a light string turn on and off simultaneously, as the lights are connected in series.

SUMMARY OF THE INVENTION

The present invention advantageously provides methods and apparatus for an improved series connected light string. In one aspect, the present invention provides a voltage regulated filament shunting circuit for use in connection with a series connected light string of incandescent flasher type light bulbs. Each flasher light is connected in parallel with a silicon type semiconductor shunting device. The shunting device has a predetermined voltage drop value which is slightly greater than the voltage normally applied to said bulbs. The semiconductor shunt becomes more conductive only when the peak voltage applied across the shunt exceeds its predetermined voltage drop value. The predetermined voltage drop for a particular shunt is exceeded whenever its associated flasher lamp opens periodically as it is designed to do or if the flasher lamp becomes inoperable. Such a circuit arrangement provides for the continued flow of current through all of the remaining lamps in the string, together with little apparent change in illumination from any of those lamps remaining operative in the string even though a substantial number of total lamps in the string are simultaneously inoperative or turned off. All but one lamp may be inoperative or off and the sole operative lamp will continue to operate.

The silicon semiconductor shunt of the present invention is designed so that it is always conducting, regardless of whether its associated lamp is "on" or "off". The shunt operates in either of two low impedance states, or in other words, two conducting levels. By operating the silicon semiconductor shunt between two low impedance conducting levels, better voltage regulation is obtained. Effectively, neither of the two low impedance states rises above several hundred ohms. The operation of the shunt in this invention occurs in the steep part of the electrical current-voltage (IV) curve beyond the "knee" where the slope rises sharply. Although the light string operates somewhat less efficiently in terms of power consumption when operating in this manner, the increased voltage regulation obtained as a consequence of this operation results in an almost flicker-free operation of the string as lights turn on and off. Visually, the effect is highly appealing.

The two conducting levels of the semiconductor shunt device can be defined as the sustaining level and the lamp filament replacement level. The sustaining level is the higher resistance of the two resistance levels in the silicon semiconductor shunt. The impedance of this level is two to eight times (preferably two to four times) that of the lamp resistance when operating normally. Further, the impedance at this level is selected so that it is not more than about 200 ohms, and preferably not more than about 100 ohms. The lamp filament replacement level is that impedance which closely matches or is slightly greater than the parallel equivalent impedance of the lamp operating in parallel with the shunt device, typically between 12 and 25 ohms.

It is therefore a principal object of the present invention to provide a simple and inexpensive silicon type semiconductor voltage regulator filament shunt, or bypass, for each of a plurality of series connected flasher light bulbs, the filament shunt having a predetermined conductive voltage drop which is only slightly greater than the voltage rating of said bulbs when operating, and the shunt becoming more conductive whenever the peak voltage applied across the shunt exceeds its predetermined voltage drop conductive value. Thus, a continued and uninterrupted flow of current is provided through each of the remaining lamps in the string, together with little apparent change in illumination from the lamps.

While this invention is directed toward tighter voltage regulation, which is desirable for a multi flashing or twinkling light string where all or most all of the lamps are of the flasher type, a light string in accordance with the present invention may comprise all regular (non-flashing) lamps or a combination of regular and flasher lamps as well.

It is another object of the present invention to provide a new series-connected random twinkle light string which has the desirable features of the lamps flashing on and off at various points in time and yet is of very simple and economical construction and is relatively inexpensive to manufacture in mass quantities, thereby keeping the overall cost of manufacturing the final product at a minimum.

It is still another object of the present invention to provide a series-connected light bulb string in which the light emitted from each flashing incandescent light bulb will optionally appear, disappear, and reappear independently and continuously along the entire string, thereby creating a most striking, novel and unusual twinkling effect.

A more complete understanding of the present invention, as well as further features and advantages of the invention, will be apparent from the following detailed description and the accompanying drawings.

DETAILED DESCRIPTION

The present invention now will be described more fully with reference to the accompanying drawings, in which several presently preferred embodiments of the invention are shown. This invention may, however, be embodied in various forms and should not be construed as limited to the embodiments set forth herein. Rather, these embodiments are provided so that this disclosure will be thorough and complete, and will fully convey the scope of the invention to those skilled in the art.

Figure 1:
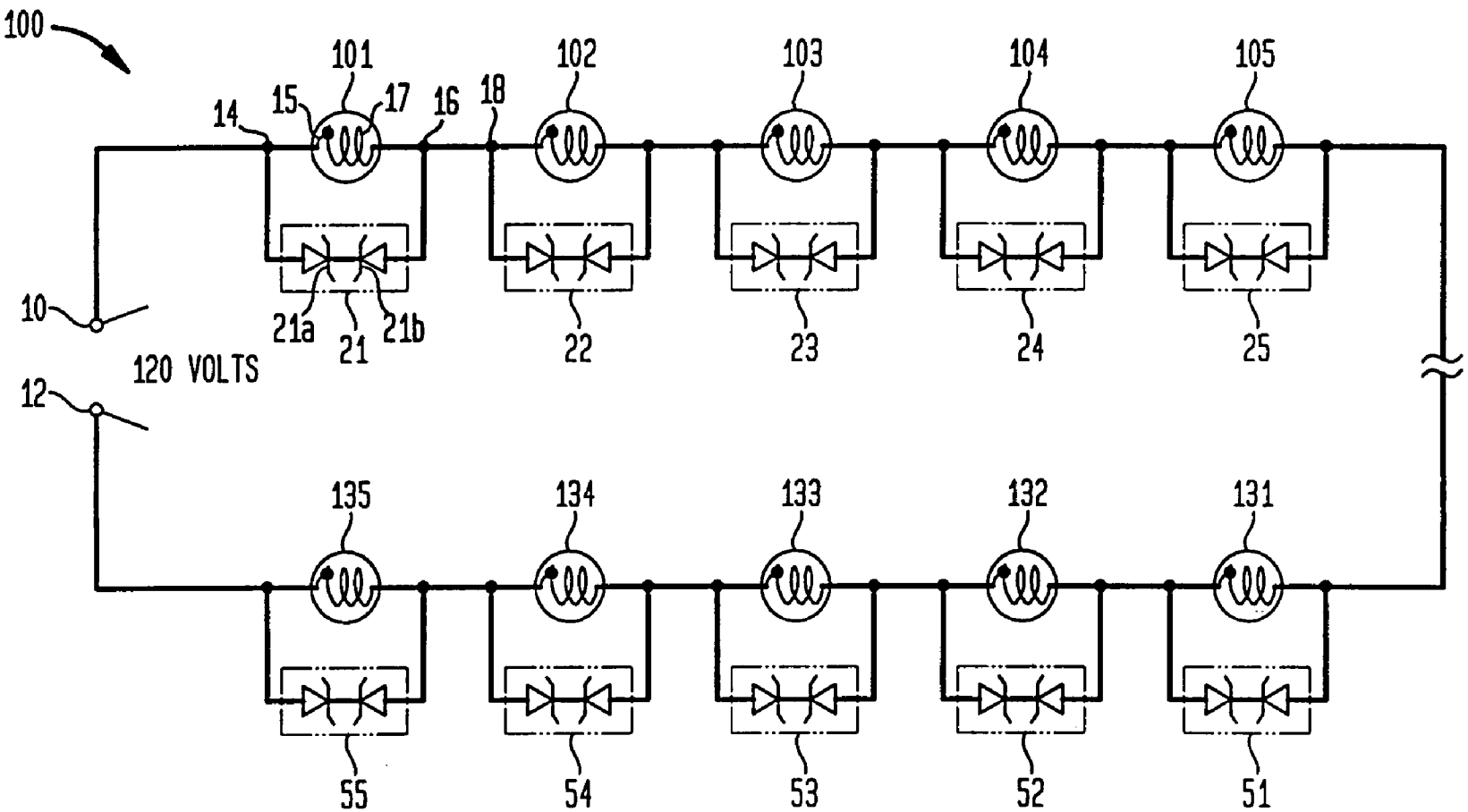
FIG. 1 shows an electrical schematic diagram of a series connected light string utilizing back-to-back Zener diode shunts in accordance with the present invention.

FIG. 1 shows a schematic diagram of a series connected light string 100 in accordance with the present invention. Input terminals 10 and 12 are adapted to be connected to a suitable electrical source, such as 120–125 volts of alternating current normally found in a typical household or business. Connected to the input terminal 10 is a first terminal 14 of a first electrical flasher light bulb 101. The electrical flasher light bulb 101 may suitably include a bimetallic strip 15 which conducts current to a filament 17 of the bulb 101. As the bimetallic strip 15 heats up, it moves away from the filament 17 and breaks the current connection, causing the bulb 101 to turn off. The bi-metallic strip 15 then cools and returns to the initial position allowing current to flow through filament 17 so that the bulb 101 turns back on.

A second terminal 16 of the first bulb 101 is electrically connected to a first terminal 18 of a second flasher type light bulb 102. Further light bulbs 103–135 are operatively connected in between the input terminals 10 and 12 to form an electrical series connection of light bulbs 101–135, as shown in FIG. 1. In a preferred embodiment, each electrical flasher light bulb may be suitably disposed in an electrical socket. While in a preferred embodiment a light string in accordance with present invention comprises 35 light bulbs, it will be recognized by those skilled in the art that a greater or fewer number of light bulbs may be used without departing from the teachings of the present invention. All the lights in the string may be of the flasher variety as presently preferred, or only a portion may be flasher lights.

Operatively connected in electrical parallel across the electrical terminals 14 and 16 of the first light bulb 101 is a first voltage sensitive silicon semiconductor device 21 which effectively functions as a first voltage regulating device, as described in greater detail below. Likewise, operatively connected in electrical parallel across the electrical terminals of the second flasher light bulb 102 is a second voltage sensitive silicon semiconductor device 22 which likewise effectively functions as a voltage regulating device. As shown in FIG. 1, further voltage sensitive silicon semiconductor devices 23–55 are connected in parallel with light bulbs 103–135, respectively.

In a preferred embodiment, as described in greater detail below, all voltage responsive silicon semiconductor devices 21–55 are of substantially identical construction and have a characteristic, such that, when operating in a low impedance state, the value of the impedance of each semiconductor device would be equal to approximately two to eight times, and preferably two to four times, of the filament impedance of the lamp operating normally, but not more than 200 ohms, and preferably not more than 100 ohms. When highly conductive, i.e. in a lowest impedance state, the impedance of each semiconductor device has a value closely matching or slightly more than the parallel equivalent impedance of the semiconductor device in parallel with the filament of the corresponding light bulb when the light bulb is operating. In other words, when the semiconductor device is in the lowest impedance state, its impedance is equal to or slightly greater than the parallel equivalent impedance of the light bulb and the semiconductor device operating in the low impedance state.

Thus, if a light bulb burns out or turns off, the shunt becomes highly conductive and begins carrying the full current of the series connected light string. If a light bulb burns out or turns off, the current carried by the shunt is equal to or only slightly less than the current carried by the string when all of the light bulbs are on. If, for example, all of the lamps are off or removed from the string, the supply voltage of 120 volts AC, appears across the series-wired 35 shunts. The current across such a string that is void of all flasher lamps is approximately 65 milliamperes. Also, any number of lamps can be removed or off with the remaining lamps in the string continuing to operate—even if all of the lamps are removed except one. That lone lamp will still operate.

As the preferred input signal for the light string 100 is an AC signal comprising a sinusoidal waveform which varies from a positive peak value to a negative peak value, the operation of the semiconductor shunt device at the low impedance state and the lowest impedance state refers to the state of the semiconductor shunt device at the peak values. In other words, the terms "low impedance state" and "lowest impedance state" describe the operation of the semiconductor shunt device at the peak, or extreme, points of the power supply signal cycle. These peak, or extreme points of the power supply signal cycle occur when the first derivative of the AC voltage supply signal across the shunt is zero.

When the light bulb is operating, and thus the semiconductor device is operating in the low impedance state, each semiconductor shunt device carries at least about 20%, and preferably at least about 30%, of the total combined current passing through the semiconductor device and the light bulb, in other words, the series connected light string. The increased voltage regulation obtained as a consequence of this results in almost flicker-free operation as light bulbs turn on and off, as a continued and uninterrupted flow of current is provided through each of the operating lamps in the string.

In a preferred embodiment, each voltage sensitive silicon semiconductor device comprises two semiconductor devices known as Zener diodes connected in a back-to-back configuration, also known as an inverse electrical series connection. For example, as shown in FIG. 1, the voltage sensitive silicon semiconductor device 21 comprises two Zener diodes 21*a* and 21*b*. The Zener diodes 21*a* and 21*b* provide desirable characteristics for an excellent voltage responsive shunt functioning as a voltage regulating device. Such back-to-back Zener diodes are readily available in the market place at relatively low cost, and this is particularly true when they are purchased in relatively large quantities.

In a preferred embodiment, each of the 35 flasher lights of the light string 100 of FIG. 1 have a voltage rating of approximately 3.5 volts, root-mean-square (RMS). The effective voltage rating for the entire string would be determined by multiplying 35 times 3.5 volts, which resultant product equals approximately 122.5 volts. Such a string is normally operated with power supplied from a 120-volt AC standard house electrical supply which has a peak voltage of approximately 170 volts. By electrically connecting two Zener diodes in a back-to-back inverse-series connection, with each having a peak Zener voltage rating of 3.3 volts at 10 milliamperes, across each lamp, the voltage across each individual lamp, with 215 milliamperes of current flow through the light string, cannot increase beyond approximately 5.0 volts peak. When a flasher lamp is illuminated, or "on", in the string, the voltage across that particular lamp is approximately 4.9 volts, peak value.

With two Zener diodes, each having a Zener voltage rating of 3.3 volts connected in a back-to-back configuration across each lamp in such a string as described, there is a partial current flow through the Zener diodes, and a partial current flow through each of the series connected flasher lamps which are in the "on" position. When a flasher lamp is "off", is removed from its respective socket, burns out, or the like, the lamp voltage appears as an open circuit and voltage across that particular lamp begins to rise toward the value of the applied line voltage. However, the two 3.3 volt Zener diodes connected back-to-back across that particular lamp limit the voltage seen across the lamp to approximately 5.0 volts peak before both Zener diodes begin to more fully conduct. This peak voltage is only slightly greater than the approximately 4.9 volts peak voltage that was dropped across the respective socket when the corresponding flasher lamp was operating properly in the "on" state. As a result, the remaining lamps in the string are little affected by the extra fractional voltage drop occurring across the Zener circuit. The partial Zener current and the partial lamp current now passes through the Zener circuit.

Figures 2, 3:
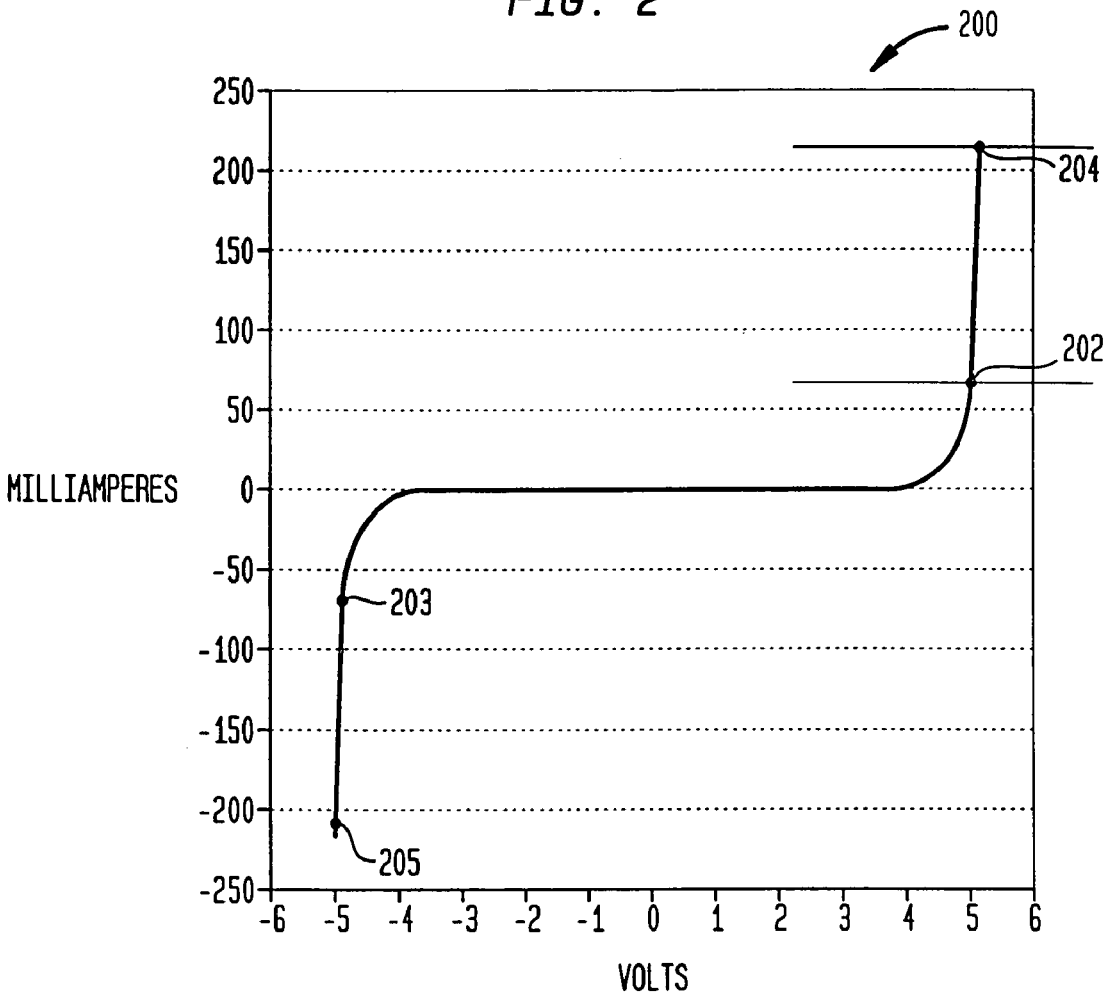
FIG. 2 shows an exemplary current and voltage graph of a shunt in accordance with the present invention.
FIG. 3 shows a table summary of the operating regions of a series connected light string in accordance with the present invention.

FIG. 2 shows a current-voltage (IV) curve 200 illustrating the current and voltage relationship for a suitable shunting device 21 comprising two back-to-back Zener diodes in accordance with the present invention. During normal operation, when the light bulb connected to the shunt in parallel is operating, the shunt operates around points 202 and 203 on the IV curve 200 at the peak, or extreme, points of the power supply signal cycle, or when the first derivative of the AC voltage supply signal is zero. In this region of operation, called the low impedance state or the sustaining level, the shunt has a relatively low impedance at the peak, or extreme, points of the power supply signal. This relatively low impedance is two to eight times, and preferably two to four times, the normal operating impedance of its associated light bulb, such as light bulb 101 of FIG. 1. Thus, for a light bulb having a normal operating impedance of 20–25 ohms, the impedance of the shunt may be 40–200 ohms, and preferably will be 40–100 ohms when the light is operating. Thus, while the majority of the current will flow through the light filament, the shunt will conduct a relatively substantial amount of current when the light is "on". For example, if the current through the light when the light is "on" is about 150 mA (RMS), the current through the shunt may be about 65 mA (RMS). When the light turns "off", the shunt then begins to conduct about 215 mA (RMS) of current.

When the light is turned off or not operating, the shunt operates near points 204 and 205 on the IV curve 200. In this region of operation, called the lowest impedance state or the lamp filament replacement level, the shunt impedance has a relatively lower impedance, with respect to the sustaining level of operation. This relatively lower impedance is selected to closely match or to be slightly greater than the parallel equivalent impedance of the shunt in parallel with the impedance of the light when operating. Thus, for a light impedance of 20–25 ohms, the impedance of the shunt is now approximately 16 ohms or slightly greater. With the light not operating, all of the current flows through the shunt circuit, allowing the other lights in the string to continue to operate. The shunt now carries the sum of the lamp current plus the normal shunt current.

FIG. 3 shows a table 300 summarizing exemplary modes of operation of a light string, like light string 100, in accordance with the present invention. When voltage is applied to the light string of the present invention, the shunt device never operates in a high impedance state at the peak, or extreme, points of the power supply signal. Thus, a relatively significant amount of current (RMS) flows through the shunt device. This condition results in better voltage regulation and a flashing light string which does not offensively flicker as lights turn off and on, as a light string with poor voltage regulation may.

Furthermore, each back-to-back Zener diode pair, or dual Zeners, is prevented from destroying itself as a result of the well-known "current runaway" condition, due to the current limiting effect provided by the remaining series connected lamps in the string whose total resistance value determines the magnitude of the current flowing therethrough.

Figure 4:
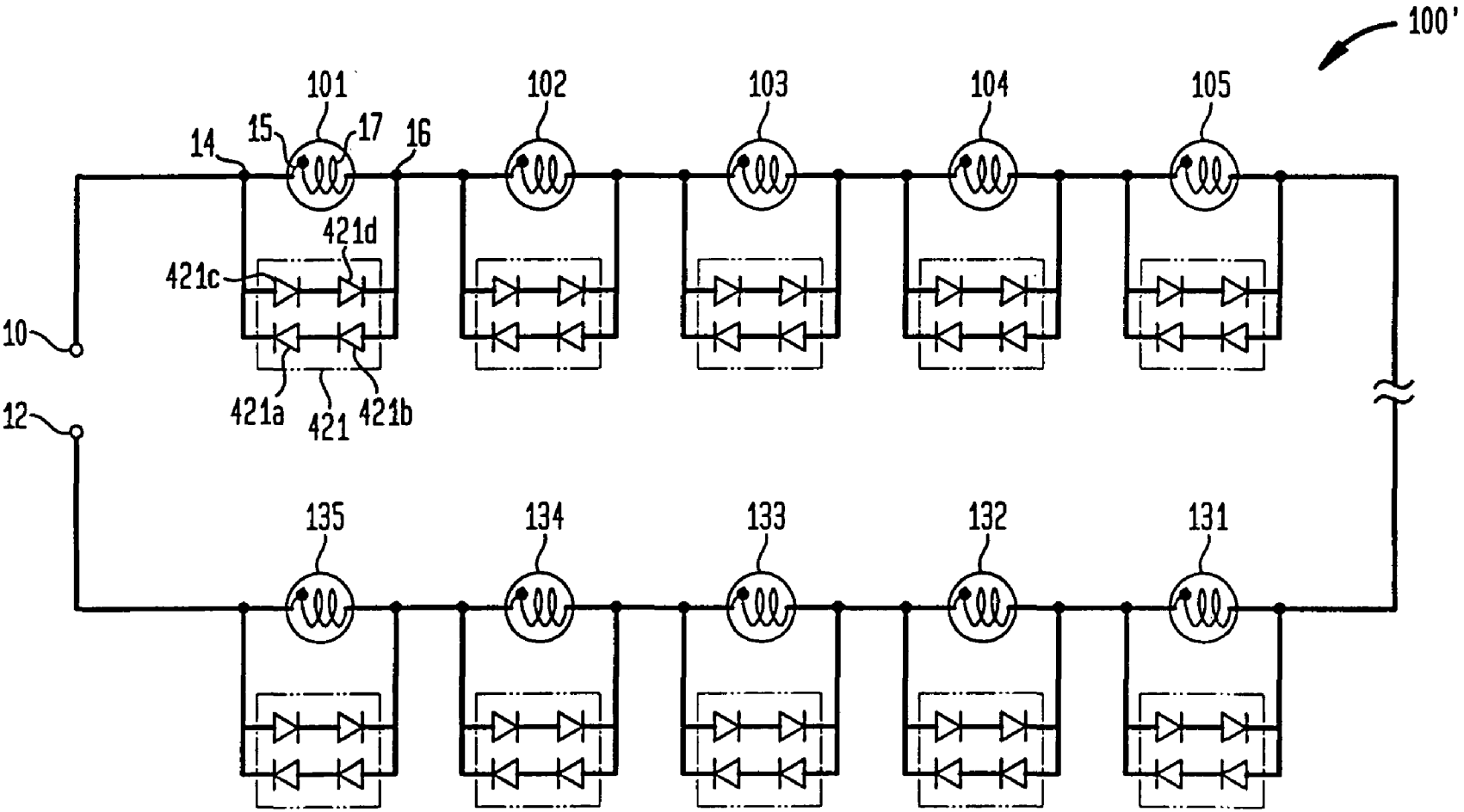
FIG. 4 shows an electrical schematic diagram of a series connected light string utilizing a diode array in accordance with the present invention.

In an alternate embodiment, as shown in FIG. 4, a diode array, such as the diode array described in U.S. Pat. No. 6,084,357 could be used as well for the silicon semiconductor shunt in this invention. U.S. Pat. No. 6,084,357 is assigned to the assignee of the present invention, shares common inventorship with the present invention and is herein incorporated by reference in its entirety. FIG. 4 shows a light string 100' comprising light bulbs 101–135. Connected across each light bulb is a diode array shunt. For example, connected across light bulb 101 is a diode array shunt 421 comprising diodes 421*a*, 421*b*, 421*c* and 421*d*. The diodes of the diode array shunt 421 are selected to allow the shunt 421 to operate in a substantially similar fashion to shunt 21 described above.

Figure 5:
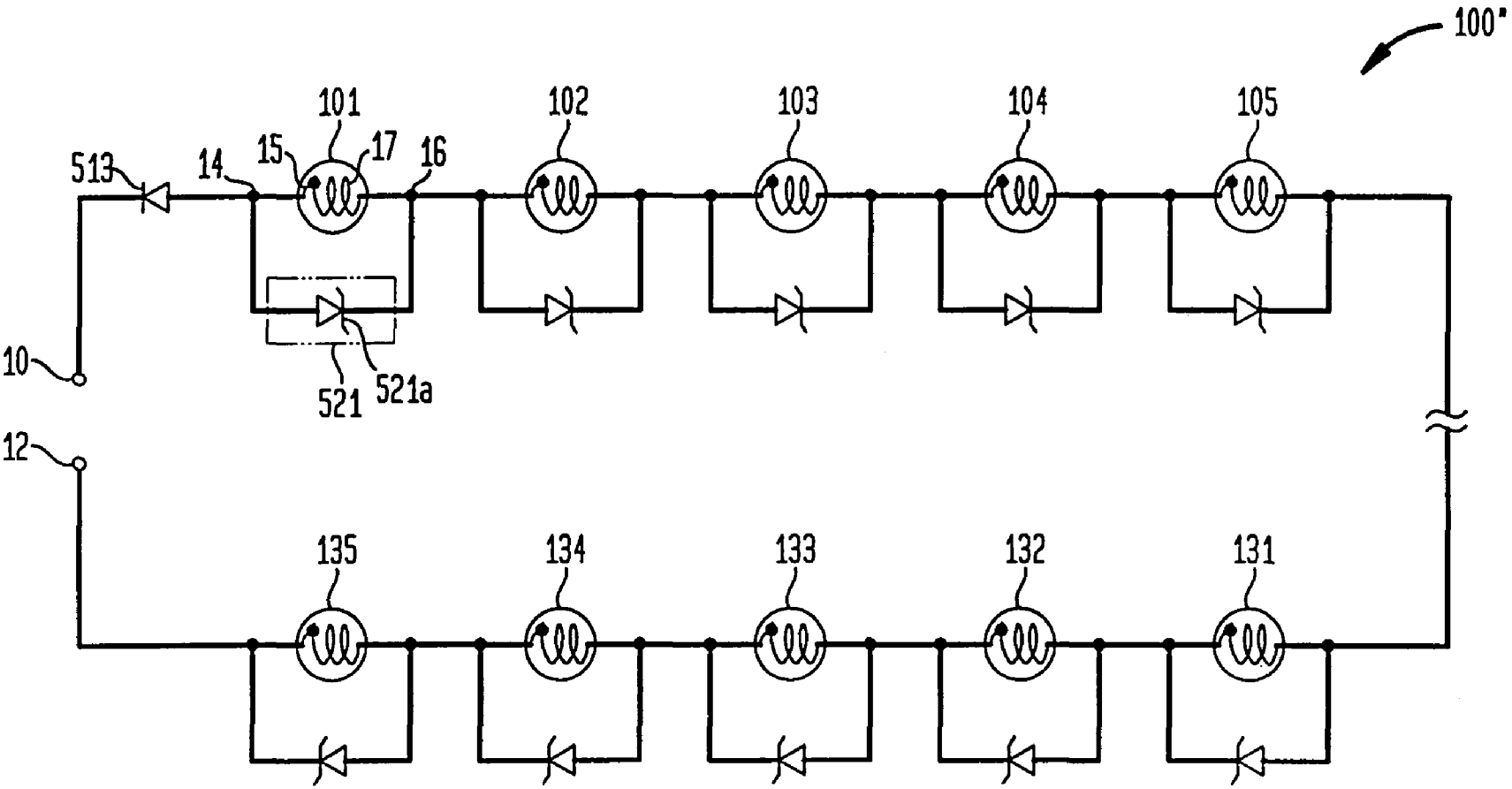
FIG. 5 shows an electrical schematic diagram of a series connected light string utilizing single Zener diode shunts in accordance with the present invention.

In another alternate embodiment, as shown in FIG. 5, a single Zener diode may be utilized with a light string operating on direct current, instead of alternating current. FIG. 5 shows a light string 100" comprising light bulbs 101–135. Connected across each light bulb is shunt comprising a single Zener diode. For example, connected across light bulb 101 is a shunt 521 comprising a single Zener diode 521*a*. While the power supplied to light string 100" is DC, for AC operation a single diode 513 may be used as a half-wave rectifier to supply DC to this circuit. Alternatively, the output from a bridge rectifier could be used to supply the input power for full wave DC operation from an AC source. The Zener 521*a* of the shunt 521 is selected to allow the shunt 521 to operate in a substantially similar fashion to shunt 21 described above for one polarity of operation.

Having so described and illustrated the principles of my invention in a preferred embodiment, it is intended, therefore, in the claims which follow, to cover all such changes and modifications as may fall within the scope and spirit of the following claims. For example, it should be readily apparent to one skilled in the art from the present teachings that other shunt devices could be used with equal success such as a diode array. Further, different Zener voltage ratings would be used for different lamps or a different number of lamps. It will also be understood that standard non-flashing 3.5 volt miniature incandescent lamps can be substituted for flasher lamps in such a string if it is desired not to have a string with 100% flashers. Any combination of flashers and non-flashers can be used, as desired.

I claim:

1. A series-wired light string that operates on DC current, comprising:

a plurality of miniature light bulbs for the decoration of Christmas trees;

a plurality of light sockets connected in series, each light socket of said plurality of light sockets adapted to receive at least one miniature light bulb of said plurality of miniature light bulbs;

a plurality of voltage-responsive semiconductor shunts, each semiconductor shunt being electrically connected in parallel across a respective light socket to maintain the current passing through the light socket in the event that a light bulb is not illuminated or is missing from the light socket; and a rectifier connected to the plurality of series-connected light sockets for rectifying an AC supply voltage for DC operation of said series-wired light string.

2. A series-wired light string as recited in claim 1, wherein the rectifier comprises a single diode which operates as a half-wave rectifier.

3. A series-wired light string as recited in claim 1, wherein the rectifier comprises a bridge rectifier for full wave rectification.

4. A series-wired light string as recited in claim 1, wherein each of the voltage-responsive shunts comprises a single Zener diode.

* * * * *